United States Patent [19]

Olesak

[11] Patent Number: 4,853,665

[45] Date of Patent: Aug. 1, 1989

[54] NOISE SUPPRESSING ISOLATION TRANSFORMER

[75] Inventor: John Olesak, Elkhorn, Wis.

[73] Assignee: General Signal Corporation, Stamford, Conn.

[21] Appl. No.: 264,474

[22] Filed: Oct. 28, 1988

[51] Int. Cl.[4] ..... H01F 15/04

[52] U.S. Cl. ..... 336/84 C

[58] Field of Search ..... 336/69, 70, 84 R, 84 C, 336/100

[56] References Cited

U.S. PATENT DOCUMENTS

| | | | |
|---|---|---|---|
| 2,170,048 | 8/1939 | Dunning et al. | 336/84 C X |
| 2,652,521 | 9/1953 | Westphal | 336/84 C |
| 4,536,714 | 8/1985 | Clark | 336/84 C X |

*Primary Examiner*—Thomas J. Kozma

*Attorney, Agent, or Firm*—R. Reichman; Robert S. Smith

[57] ABSTRACT

A transformer apparatus which includes a core and first and second coils which are each magnetically coupled to the core. Each coil is generally cylindrical and have a circumferential surface and first and second axial extremities. Shielding is disposed around at least the first coil comprising a web shaped metallic, non-magnetic, electrically conductive generally rectangular member. The member has a first portion extending around substantially the entire circumferential extent of at least one coil and the member further includes second and third portions extending respectively about a substantial portion of each of the first and second axial extremities.

25 Claims, 2 Drawing Sheets

NOISE SUPPRESSING ISOLATION TRANSFORMER

BACKGROUND OF THE INVENTION

The invention relates to transformers and particularly to common mode noise attenuation in transformers in the single phase range of 0.125 KVA to 15 KVA. The invention may also be applied to three phase transformers in ranges up to 45 KVA. The basic transformer has current in the primary that develops a fluctuating magnetic field. The field cuts the turns of the secondary to develop an electromotive force in the secondary. In addition to the desired electromotive force, other components that are not desired also pass over from the primary to the secondary as well as from the secondary to the primary. These undesired components are called noise. For many applications the noise is not objectionable. For many other applications the noise is objectionable and such applications include power supplies for computers and other data processing equipment, medical equipment and other voltage sensitive devices. Problems that may be encountered when such noise is transmitted may include the loss or change of data held in volatile memory or interference with electronic control equipment. For example, noise from a power line may introduce spurious signals into a computer operating system and these signals can be processed as significant data which may result in extra or missing bits which can drastically change the results. Similarly, an important factor is that certain rotating equipment, for example, may impose noise on the power line and this noise may effect other equipment that is connected to that line. Thus it is desirable to minimize both noise transferred from the primary to the secondary of the transformer, as well as from the secondary to the primary. The prior art includes two known methods to achieve high common mode attenuation. The first involves spiral wrapping a coil in a manner similar to a "tire-wrap" using a conductive foil tape. The second uses a shield of relatively thick rigid conductor preformed by a machine into a box-like configuration which slides over the preinsulated coil. Better attenuation is achieved by the first method because the preformed shield is arranged in closer proximity to the coil conductors. The spiral method is, however, undesireable because it is highly labor intensive. The box-like configuration is undesirable because it requires precise dimensioning and tooling, and the shield must be manufactured prior to assembly of the transformer.

The Faraday shield is well known and has been widely used. Applications include the use of a conductive foil placed between coils of the transformer to divert noise to ground. In some cases, capacitance around such a Faraday shield will still couple enough noise from the primary to the secondary to cause problems in very sensitive equipment. It is also known to use variations of the Faraday shield which is essentially a box shield which completely encloses the winding with a conductive foil. The box shield provides a ground path for primary circuit noise and has the advantage that a much smaller capacitance exists between primary and secondary coils than in the case of a simple Faraday shield.

The prior art has used various stamped metallic members which are intended to fit around at least some of the windings of a transformer. Such a prior art approach is shown in the layout view of FIG. 2. It will be seen that known shield involves a relatively complicated pattern which involves difficult assembly onto a transformer winding.

The prior art includes the structures shown in the following U.S. Pats. Nos. 2,978,658 Reaves; 3,983,522 Gearhart; 2,997,647 Gaugler et al; 4,236,133 Seiersen; 3,181,096 Raub; 4,311,977 Owen; 3,717,808 Horna; 4,454,492 Thackray; 3,886,434 Schreiner; 4,554,523 Miki et al; 3,982,814 Kaisrswerth et al; 4,571,570 Wiki et al; 3,278,877 Kameya et al; 3,560,902 Okuyama; 3,678,428 Morris et al; 3,699,488 Goodman et al; 4,042,900 Hinton et al; 4,153,891 McNutt; 4,518,941 Harada.

Of these listed Patents, U.S. Pat. No. 4,042,900 Hinton et al, describes a floating electrostatic shield for disc windings. U.S. Pat. No. 3,699,488 Goodman et al, describes a static shield for each winding section which comprise a strip of aluminum-backed crepe paper. U.S. Pat. No. 4,153,891 McNutt, describes an electrostatic shield assembly for power transformer winding. Similarly, U.S. Pat. No. 4,518,941 Harada, describes two electrostatic shield foils imposed between the primary and secondary windings with an insulator disposed between the electrostatic shield foils. The other patents are only of general interest.

It is an object of the invention to provide effective common-mode noise attenuation without the complexity involved in tooling and stamping a shield such as that prior art shield shown in FIG. 2.

It is an object of the invention to provide apparatus which is inexpensive to manufacture as well as requires a minimum of labor to install.

Still another object of the invention is to provide a shield which is highly effective.

It is an object of the present invention to provide a coil shield which can be fabricated at the assembly floor and does not have to be fabricated by means involving relatively elaborate tooling with precise 4 dimensional controls.

SUMMARY OF THE INVENTION

It has now been found that these and other objects of the invention may be attained in a transformer apparatus which may comprise a core, first and second coils which may each be magnetically coupled to the core, each coil being generally cylindrical and having a circumferential surface and first and second axial extremities. Shielding is disposed around at least the first coil which includes a web shaped metallic, non-magnetic, electrically conductive generally rectangular member. The member has a first portion extending around substantially the entire circumferential extent of the one coil. The member further includes second and third portions extending respectively about a substantial portion of each of the first and second axial extremities.

The second and third portions may include a plurality of slits whereby tab shaped parts may be defined in the second and third portions. Each of the tabs may be substantially rectangular. The member may include nine tabs defined in the second portion and nine additional tabs in the third portion. The first coil may have a plurality of substantially planar faces, the plurality substantially planar faces may intersect along a plurality of lines and the member may be dimensioned and configured with each of the slits being disposed in end abutting relationship to one of the lines. The member may also extend circumferentially around the coil starting at one of the generally planar faces and extends less than a full 360 degrees about the first coil to provide a gap intermediate the ends of the member. In addition, the member may be dimensioned and configured with a gap intermediate two of the tabs proximate to the one planar face. The core may have an E-shaped section which may have first, second and third substantially parallel, substantially coplanar, spaced apart legs and an I-shaped section, the second leg may be disposed intermediate the first and third legs. At least the first coil may be disposed in coaxial relationship with the second leg. Both the first and second coils may be disposed in coaxial concentric relationship with the second leg. The apparatus may include a layer of aramid insulation underneath the member and a second layer of aramid insulation over the member. The member may be aluminum. The member may be less than 15 mils thick. Each of the coils may include a base tube and the base tube has a non-magnetic, electrically conductive metallic covering thereon.

In still another form of the invention the shielding is disposed around both the first and second coils. In some forms of the invention, the member which provides the shielding is exactly rectangular.

BRIEF DESCRIPTION OF THE DRAWING

The invention will be better understood by reference to the accompanying drawing in which.

DESCRIPTION OF THE PREFERRED EMBODIMENT

Referring now to FIGS. 1, 3, 4 and 5 there is shown a transformer 10 having a core 12 which in the preferred embodiment is of the type having an E-shaped and I-shaped core in which the windings or coils 14, 16 are disposed in concentric relationship about the center of the three parallel, coplanar legs of the E-shaped core. Because this construction is conventional it has not been shown in great detail.

Figure 2:
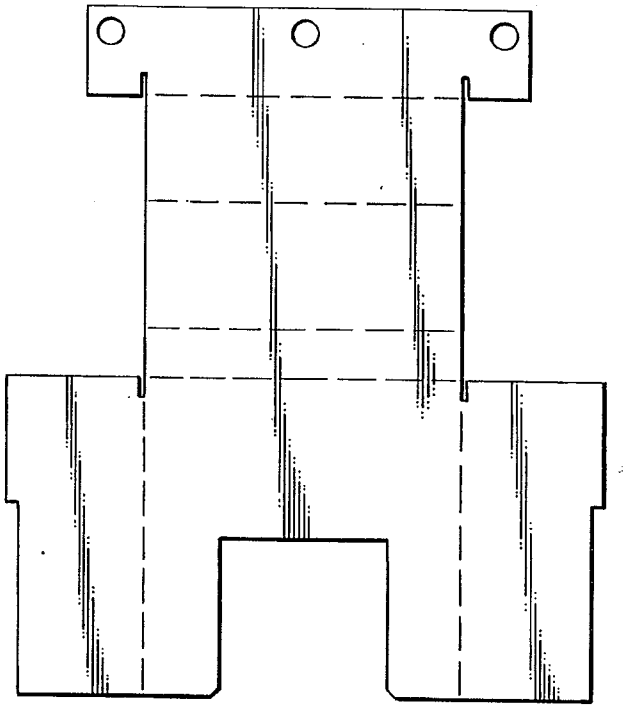
FIG. 2 PRIOR ART
FIG. 2 is a layout of a prior art shield for a transformer.
Figure 1:
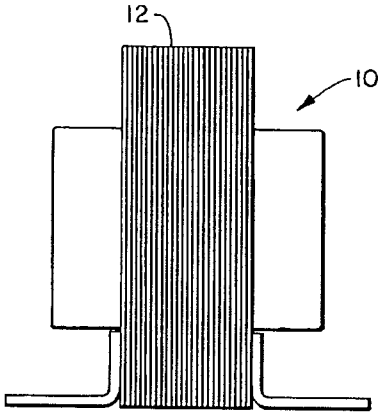
FIG. 1 is a side elevational view of a shell type transformer in accordance with one form of the invention.
Figure 3:
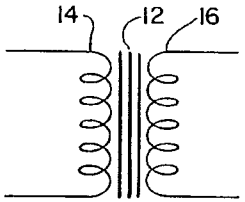
FIG. 3 is a schematic view of a transformer core, primary and secondary windings.
Figure 4:
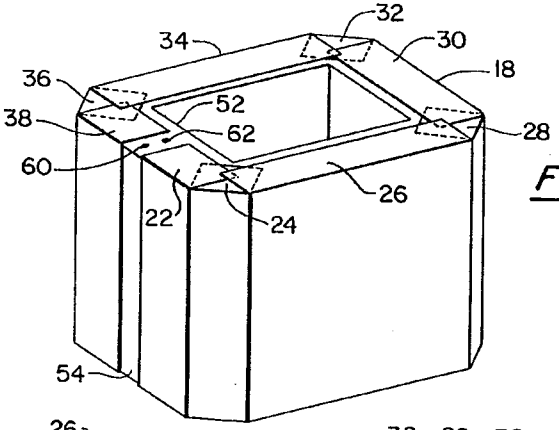
FIG. 4 is a perspective view of a coil in accordance with the present invention.
Figure 5:
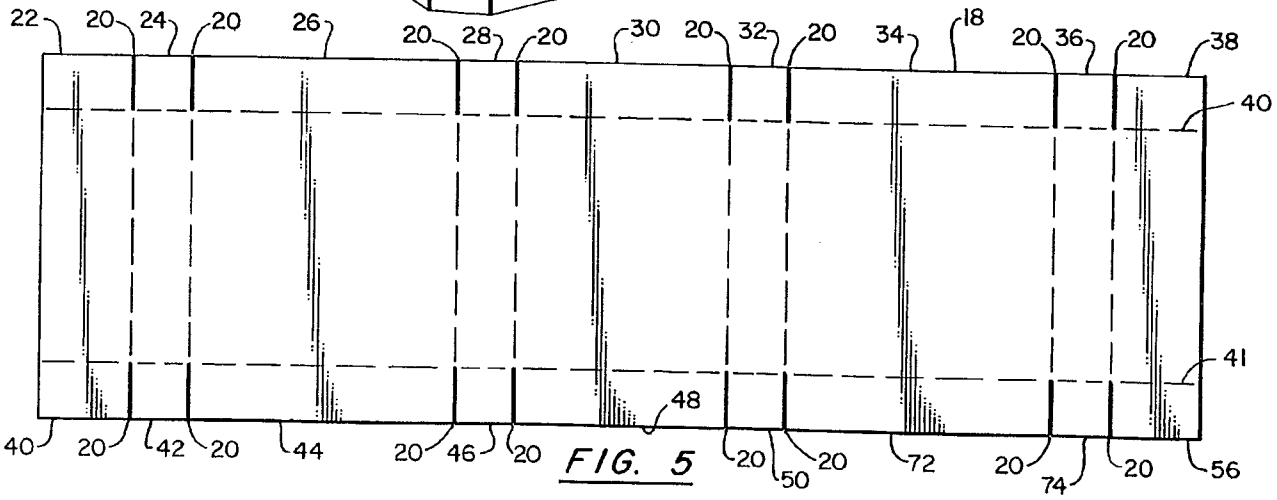
FIG. 5 is a partially schematic layout showing the shield construction in accordance with the present invention and more particularly the shield shown in FIG. 4.

Referring now to FIGS. 4 and 5 there is shown the shield 18 in accordance with one form of the invention. The shield 18 in the preferred embodiment is manufactured of an aluminum foil having a maximum thickness of about 15 mils. More commonly, it will have a thickness of 9 mils. The shield 18 includes a layer of insulation, a layer of foil and another layer of insulation. The layer of insulation will ordinarily be slightly larger than the foil to avoid electrical creepage. The shield 18 is provided with a plurality of slits 20 which define 9 discrete tabs on a second or upper, as viewed, portion of the shield 18. These nine tabs are respectively identified by the numerals 22, 24, 26, 28, 30, 32, 34, 36 and 38. The dashed line identified by the numeral 39 will be understood to show the fold line for the respective tabs 22–38 and will also define the limit of the second portion. Similarly, the dashed line 41 defines the third or lower portion as viewed, of the shield 18 and thus the upper limit and fold line for the 9 tabs 40, 42, 44, 44, 46, 48, 50, 56, 72, and 74. It will be understood from FIG. 5 that the tabs 22 and 40 are identical in size and shape as are the tabs 24 and 42, 26 and 44, 28 and 46, 30 and 48, 32 and 50, 34 and 72, 36 and 74 as well as 38 and 56. The shield 18 is wrapped around the coil 52 in the manner shown in FIG. 4. More particularly, the coil 52 will be understood to be substantially cylindrical although it may have substantially planar faces and the term generally cylindrical will be used herein to encompass coil forms which have exterior contours which approach or actually are a polygon as well as cores which have an internal contour which is a polygon such as the coil 52 which is shown in FIG. 4 with a rectangular cross section. On one face 54 of the coil 52, the shield 18 is initially installed with the tabs 22 and 40 folded against the respective axial extremities. The shield 18 is dimensioned and configured so that the slits 20 are disposed in end abutting alignment with lines that define generally planar exterior surfaces of the coil 52. Thus, the slits 20, 20 that define the tab 24 are aligned with the lines defining a generally planar section of the coil 52. The same applies for the respective pairs of slits 20, 20 defining the tabs 26, 28, 30, 32, 34, 36 and 38 as well as the slits 20, 20 defining the tabs 40, 42, 44, 46, 48, 50, 52, 54 and 56 which are fixed to the lower, as viewed, axial extremity of the coil 52. As shown in FIG. 4 the tabs 24, 28, 32 and 36 are folded down in the "corner" of the core 52 and are overlapped respectively by the tabs 22, 26, 30, 34 and 38 as shown in FIG. 4. The shield 18 is held in place by adhesive tape (not shown).

To avoid a shorted turn, a gap is left between the ends of the shield 18. More particularly, the shield 18 does not extend a full 360 degrees around the coil 52. The gap is shown in the generally planar section 54 of FIG. 4. It will be further seen that the leads 60, 62 extend axially from the coil 52 intermediate the gap between the tabs 22 and 38. In a similar manner, a gap is provided between the gaps 56 and 40 in the lower axial, as viewed, axial extremity of the coil 52.

Because the material of the shield 18 is relatively easy to work with, there are substantial advantages in terms of ease of installation. Ordinarily the shield 18 will be a non-magnetic, electrically conductive metallic member such as copper, aluminum or tin. The shield 18 includes an inner and outer layer of insulation. Ordinarily this will be layers of Nomex (a DuPont trademark) aramid insulation having substantially the same shape and dimensions as the metallic portion of the shield 18. More particularly, the insulation will have slightly larger dimensions than the metallic portions of the shield 18 to provide an electrical creep distance. In other words the insulating material will extend further along the axial extremity of the coil 52 than does the metallic portion of the shield 18. The shield 18 is connected by a cold-welded aluminum piercing connector which is terminated to the end of a flexible lead wire.

The transformer 10 ordinarily includes two coils such as 52 which are disposed in coaxial concentric relationship. Each coil 52 includes a core former which will be covered by a sheet of non-magnetic, electrically conductive metal which, in the preferred embodiment, is aluminum and will have the same thickness as the shield 18. This sheet does not touch the shield 18 and is also insulated from the inner diametral surface of the coil 52. Ordinarily, this sheet will not be grounded. The shield 18 ordinarily is grounded. As noted above, the term cylindrical has been used herein to describe one form of the coil. It will be understood that the coils may have a square or rectangular cross section or other polygon cross section and the term "generally cylindrical" as used herein should be understood to include such other forms. Similarly, it will be understood that reference herein to a coil having a plurality of generally planar faces encompasses coils that approach a polygon cross section as well as those that have a true cylindrical cross section. Those skilled in the art will recognize that the coils will usually have some form intermediate a circular cross section and a polygon cross section.

Having thus described my invention I claim:

1. A transformer apparatus which comprises:

a core;

first and second coils which are magnetically coupled to said core, each coil being generally cylindrical and having a circumferential surface and first and second axial extremities; and shield disposed around at least said first coil comprising a web shaped metallic, non-magnetic, electrically conductive generally rectangular member, said member having a first portion extending around substantially the entire circumferential extent of said one coil, said member further including second and third portions extending respectively about a substantial portion of each of said first and second axial extremities said second and third portions include a plurality of slits whereby rectangular tabs are defined in each of said second and third portions.

2. The apparatus as described in claim 1 wherein:

said member includes nine said tabs defined in said second portion and nine additional said tabs in said third portion.

3. The apparatus as described in claim 2 wherein:

said first coil has a plurality of substantially planar faces, said plurality of substantially planar faces intersect along a plurality of lines, said member being dimensioned and configured with each of said slits being disposed in end abutting relationship to one of said lines.

4. The apparatus as described in claim 3 wherein:

said member extends circumferentially around said coil starting at one of said generally planar faces and extends less than a full 360 degrees about said first coil to provide a gap intermediate the ends of said member.

5. The apparatus as described in claim 4 wherein:

said member is dimensioned and configured with a gap intermediate two of said tabs proximate to said one planar face.

6. The apparatus as described in claim 5 wherein:

said core has an E-shaped section having first, second and third substantially parallel, substantially coplanar, spaced apart legs and an I-shaped section, said second leg being disposed intermediate said first and third legs.

7. The apparatus as described in claim 6 wherein:

at least said first coil is disposed in coaxial relationship with said second leg.

8. The apparatus as described in claim 7 wherein:

both said first and second coils are disposed in coaxial concentric relationship with said second leg.

9. The apparatus as described in claim 8 wherein:

including a layer of aramid insulation underneath said member.

10. The apparatus as described in claim 9 further including:

a second layer of aramid insulation over said member.

11. The apparatus as described in claim 10 wherein:

said member is aluminum.

12. The apparatus as described in claim 11 wherein:

said member is less than 15 mils thick.

13. The apparatus as described in claim 1 wherein:

each of said coils includes a base tube and said base tube has a non magnetic, electrically conductive metallic covering thereon.

14. A transformer apparatus which comprises:

a core;

first and second coils which are magnetically coupled to said core, each coil being generally cylindrical and having a circumferential surface and first and second axial extremities;

each of said coils including a base tube and each of said base tubes has a non-magnetic, electrically conductive metallic covering thereon;

shielding disposed around both said first and second coils, said shielding on each coil comprising a web shaped metallic non- magnetic, electrically conductive generally rectangular member, said member having a first portion extending around substantially the entire circumferential extent of said one coil, said member further including second and third portions extending respectively about a substantial portion of each of said first and second axial extremities said second and third portions include a plurality of slits defining rectangular tabs in each said second and third portions.

15. The apparatus as described in claim 14 wherein:

said member includes nine said tabs defined in said second portion and nine additional said tabs in said third portion.

16. The apparatus as described in claim 15 wherein:

said first coil has a plurality of substantially planar faces, said plurality of substantially planar faces intersecting along a plurality of lines, said member;

being dimensioned and configured with each of said slits being disposed in end abutting relationship to one of said lines.

17. The apparatus as described in claim 16 wherein:

said member extends circumferentially around said coil starting at one of said generally planar faces and extends less than a full 360 degrees about said first coil to provide a gap intermediate the ends of said member.

18. The apparatus as described in claim 17 wherein:

said member is dimensioned and configured with a gap intermediate two of said tabs proximate to said one planar face.

19. The apparatus as described in claim 18 wherein:

said core has an E-shaped section having first, second and third substantially parallel, substantially coplanar, spaced apart legs and an I-shaped section, said second leg being disposed intermediate said first and third legs.

20. The apparatus as described in claim 19 wherein:

at least said first coil is disposed in coaxial relationship with said second leg.

21. The apparatus as described in claim 20 wherein:

both said first and second coils are disposed in coaxial concentric relationship with said second leg.

22. The apparatus as described in claim 21 wherein:

including a layer of aramid insulation underneath said member.

23. The apparatus as described in claim 22 further including:

a second layer of aramid insulation over said member.

24. The apparatus as described in claim 23 wherein:

said member is aluminum.

25. The apparatus as described in claim 24 wherein:

said member is less than 15 mils thick.

* * * * *